BEST AVAILABLE COPY

United States Patent [19]

Chen

[11] Patent Number: 5,025,761

[45] Date of Patent: Jun. 25, 1991

[54] VARIABLE VALVE-TIMING DEVICE

[76] Inventor: Kuang-Tong Chen, No. 163, Chung Chen N. Rd., San Chung City, Taipei Hsien, Taiwan

[21] Appl. No.: 537,374

[22] Filed: Jun. 13, 1990

[51] Int. Cl.[5] ..... F01L 1/34

[52] U.S. Cl. ..... 123/90.16; 123/90.15

[58] Field of Search ..... 123/90.15, 90.16, 90.17

[56] References Cited

U.S. PATENT DOCUMENTS

| | | | |
|---|---|---|---|
| 4,397,270 | 8/1983 | Aoyama | 123/90.16 |
| 4,438,736 | 3/1984 | Hara et al. | 123/90.16 |
| 4,526,142 | 7/1985 | Hara et al. | 123/90.16 |
| 4,643,141 | 2/1987 | Bledsoe | 123/90.16 |
| 4,724,822 | 2/1988 | Bonvallet | 123/90.16 |
| 4,768,475 | 9/1988 | Ikemura | 123/90.16 |

FOREIGN PATENT DOCUMENTS

| | | | |
|---|---|---|---|
| 0114633 | 9/1979 | Japan | 123/90.16 |

*Primary Examiner*—Charles J. Myhre
*Assistant Examiner*—Weilun Lo
*Attorney, Agent, or Firm*—Poms, Smith, Lande & Rose

[57] ABSTRACT

A variable valve-timing device for an intake or exhaust valve in a cylinder head of an internal combustion engine operated directly from a camshaft includes a low speed rocker arm mounted on a low speed rocker arm shaft and a high speed rocker arm mounted on a high speed rocker arm shaft. The low speed rocker arm and the high speed rocker arm are interconnected by a pin. A low speed cam is provided on the camshaft corresponding with the low speed rocker arm. A high speed cam is provided on the camshaft corresponding with the high speed rocker arm. The low speed rocker arm shaft and the high speed rocker arm shaft have a common fluted shaft. An outer circular hollow shaft is provided on the common fluted shaft and the low speed rocker arm is mounted on the outer circular hollow shaft. An outer hollow eccentric shaft having a slot with a cross section corresponding to the common fluted shaft is provided on the common fluted shaft and the high speed rocker arm is mounted on the eccentric shaft which is rotatably mounted on the engine head. An end of the fluted shaft is provided with a worm wheel meshed with a worm mounted to an output shaft of a driving device.

6 Claims, 3 Drawing Sheets

VARIABLE VALVE-TIMING DEVICE

BACKGROUND OF THE INVENTION

The present invention relates to a variable valve-timing device for internal combustion engines, particularly to a cam structure including a high speed cam with a high speed rocker arm for high speed operation of engine and a low speed cam with a low speed rocker arm for low speed operation of engine.

Conventionally, operating engine valve-timing is fixed by design. However, it is a well-known drawback that low speed engines are unable to perform properly at high speed and that high speed engines are inefficient at low speed. In order to obtain an excellent performance at both low speed and high speed for both low speed engines and high speed engines, even any type of engine, the timing of valves should be variable in response to the speed of the engine and other factors, such as engine load, the speed of car, and water temperature of cooling system, etc. In other words, the opening time of intake and exhaust valves should increase or decrease in response to an increase or a decrease of engine speed and other factors. The present invention intends to provide a variable valve-timing structure to eliminate the above mentioned problems and to provide for economical fuel consumption.

SUMMARY OF THE INVENTION

It is an object of the present invention to provide a variable valve-timing device for internal combustion engines, the variable valve-timing device including a high speed cam with a high speed rocker arm for high speed operation of engine and a low speed cam with a low speed rocker arm for low speed operation of engine.

It is another object of the present invention to provide a variable valve-timing device for internal combustion engines of a wider than conventional speed range.

It is still another object of the present invention to provide a variable valve-timing device for internal engines which are economical in fuel consumption.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
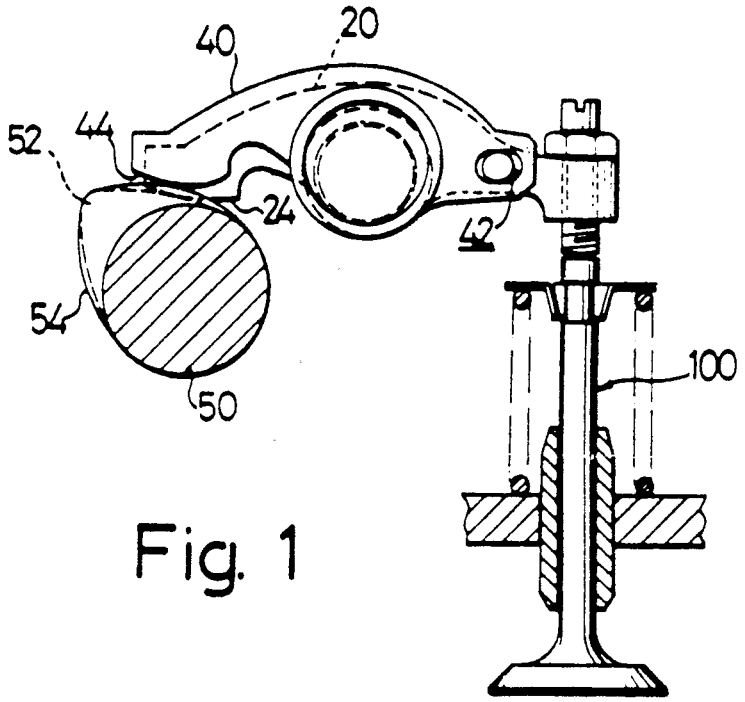
FIG. 1 is a schematic view, partly cross-sectioned, of a variable valve-timing device for a valve, in a cylinder head of an internal combustion engine, operated by the two rocker arms directly from a camshaft in accordance with the present invention.
Figure 2:
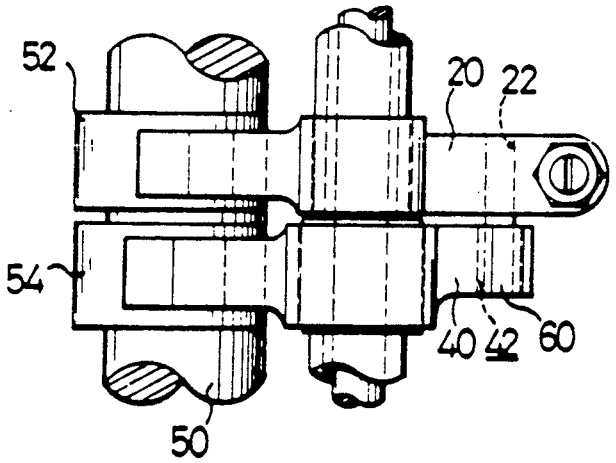
FIG. 2 is a schematic top view of FIG. 1 showing the variable valve-timing device in accordance with the present invention.
Figure 3:
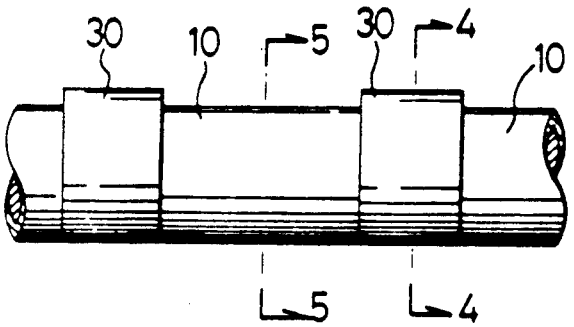
FIG. 3 is a plane view of a rocker arm shaft according to the present invention.

Referring to FIGS. 1 through 3, the variable valve-timing device according to the present invention comprises a low speed rocker arm 20 mounted on a low speed rocker arm shaft 10 and a high speed rocker arm 40 mounted on a high speed rocker arm shaft 30 for a valve 100 in the cylinder head (not shown) operated by the two rocker arms 20, 40 directly from a camshaft 50. The low speed rocker arm 20 and the high speed rocker arm 40 are interconnected by suitable means, such as a pin 60 provided in a pin slot 42 of the high speed rocker arm 40 and a pin hole 22 of the low speed rocker arm 20 wherein both the pin slot 42 and the pin hole 22 are adjacent to the valve 100.

On the camshaft 50 there are provided a low speed cam 52 and a high speed cam 54 respectively corresponding with the low speed rocker arm 20 and the high speed rocker arm 40. The low speed cam 52 has a cam lobe which has a cam face for contacting with a rocker arm face 24 of the low speed rocker arm 20. The high speed cam 54 also has a cam lobe which has a cam face for contacting with a rocker arm face 44 of the high speed rocker arm 40.

Figure 4:
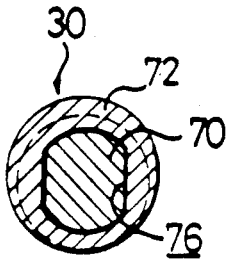
FIG. 4 is a cross-sectional view taken along line 4—4 of FIG. 3.
Figure 5:
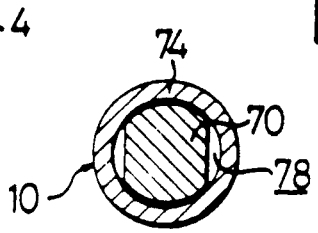
FIG. 5 is a cross-sectional view taken along line 5—5 of FIG. 3.
Figure 6:
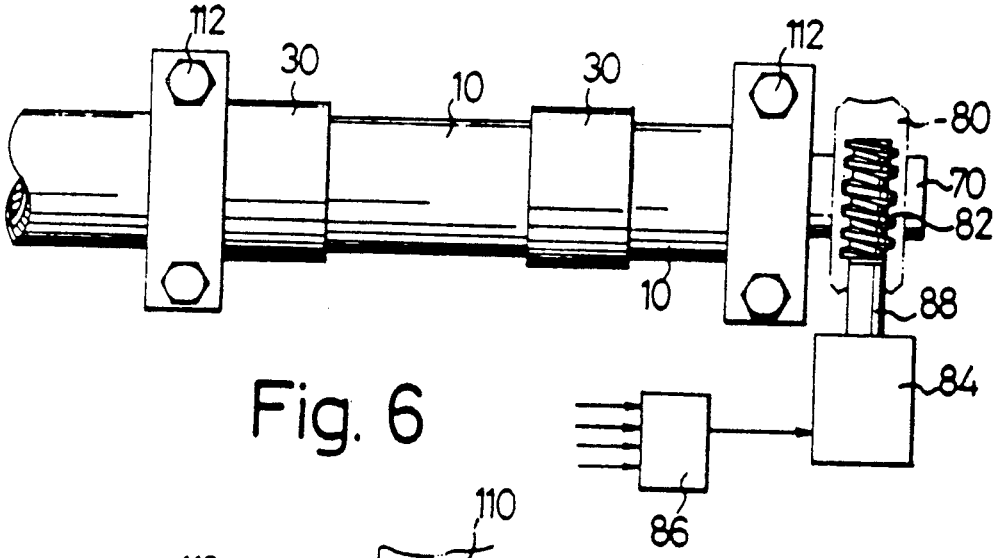
FIG. 6 is a schematic plane view showing the controlling of the rocker arm shaft by means of a step motor.
Figure 7:
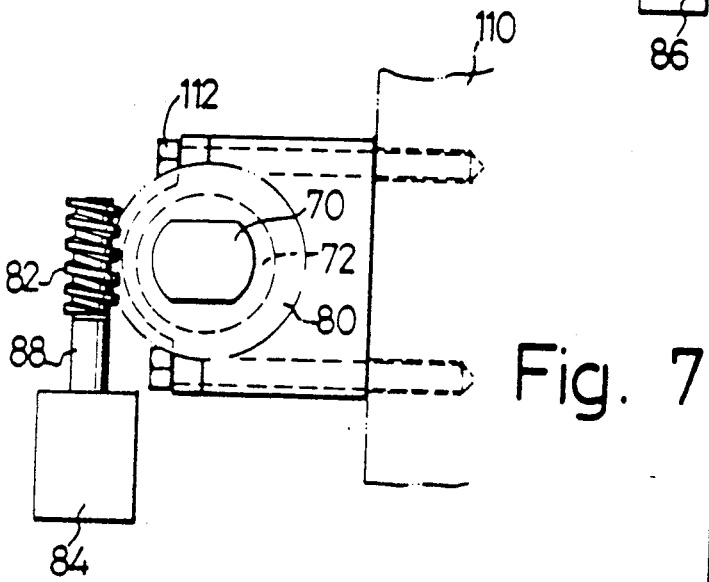
FIG. 7 is a right-side view of FIG. 6.

Referring to FIGS. 3 to 5, the low speed rocker arm shaft 10 and the high speed rocker arm shaft 30 comprise a common fluted shaft 70 in which an outer circular hollow shaft 74 having a circular through hole 78 therein is provided on the common fluted shaft 70 and the low speed rocker arm 20 is mounted on the outer circular hollow shaft 74 while an outer hollow eccentric shaft 72 having a slot 76 with a cross section corresponding to the common fluted shaft 70 is provided on the common fluted shaft 70 and the high speed rocker arm 40 is mounted on the eccentric shaft 72. As can be seen in FIGS. 5 through 7, the common rocker arm shaft is mounted on an engine head 110 at the the circular hollow shaft 72 section by means of suitably spaced fixing means 112. Shown in FIG. 6 is the common fluted shaft 70 provided with two pairs of circular hollow shaft 74 and eccentric shaft 72 for two valves of a cylinder. A plurality of pairs of circular hollow shaft and eccentric shaft can be provided for a plurality of valves of the engine. As shown in FIG. 6, at an end of the fluted shaft 70 there is mounted a worm wheel 80 meshed with a worm 82 mounted to an output shaft 88 of a step motor 84, which will be discussed in detail later.

Referring to FIG. 5, the circular hollow shaft 74 does not rotate with the fluted shaft 70 when the fluted shaft 70 is driven by the step motor 84 through the worm 82 and the worm wheel 80. Therefore, the relative phase angle of the low speed rocker arm 20 and the low speed cam 52 during circumferential motion remains unchanged during the operation of the engine. On the other hand, as shown in FIG. 4, the eccentric shaft 72 rotates with the fluted shaft 70 when the fluted shaft 70 is driven by the step motor 84. For example, when the engine speed increases above a preset valve, upon rotation of the inner fluted shaft 70, the high speed rocker arm 40 is made to contact with the cam face of the high speed cam 54. The eccentricity of the high speed cam is such as to prolong the opening of the corresponding valve. Consequently, the effect of having transferred control of valve opening to the differently shaped surface of the high speed cam prepares for more efficient operation at high speed, even including variability in timing produced by a phase shift of valve opening to piston head dead center. If the engine utilizes this variability potential, a high engine speed will cause the corresponding valve to open longer. When the high speed rocker arm is in contact with the high speed cam surface, it is the high speed rocker arm that controls the opening of the corresponding valve.

Conversely, when the engine speed decreases to a lower speed, but still higher than the pre-set valve, the inner fluted shaft 70 is rotated in a reverse direction and the opening period of the corresponding valve decreases. When the engine speed decreases below the pre-set valve, the control of valve opening reverts to the low cam surface.

As shown in FIG. 1, a first portion of the pin 60 is tightly received in the pin hole 22 of the low speed rocker arm 20 and a second portion of the pin 60 is received in the pin slot 42 of the high speed rocker arm 40. The pin slot 42 of the high speed rocker arm 40 extends in a direction perpendicular to a longitudinal axis of the pin 60 so as to allow the high speed rocker arm 40 to move circumferentially relative to the low speed rocker arm 20.

Still referring to FIG. 1, the cam face of the low speed cam 52 contacts with the rocker arm face 24 of the low speed rocker arm 20 in a unchanged mode while the cam face of the high speed cam 54 still has clearance with the rocker arm face 44 of the high speed rocker arm 40 at low engine speed even when the low speed cam reaches its head dead center (H.D.C.), i.e., the cam face of the high speed cam 54 does not contact with the rocker arm face 44 of the high speed rocker arm 40 below the pre-set low engine speed.

As shown in FIGS. 6 and 7, the step motor 84 is controlled by a power controlling unit, such as an electronic control unit (ECU) which receives the messages of engine speed, engine load, car speed and water temperature, etc., to drive the worm 82 to rotate which in turn rotate the worm wheel 80 and the fluted shaft 70. The ECU is so programmed that it can calculate from the data of the engine speed, engine load, car speed and water temperature, etc., to decide an appropriate power supply regime to the step motor. As shown in FIGS. 4 and 5, the eccentric shaft 72 rotates with the fluted shaft 70 such that the rocker arm face 44 of the high speed rocker arm 40 moves to contact with the cam face of the high speed cam 54 in a wider range or a smaller range. Accordingly, the opening phase angle of the valve is altered in response to outside condition, such as engine speed, engine load, car speed and water temperature of cooling system. It would be appreciated that the opening phase angle of the valve controlled by means of the step motor is variable.

Figure 8:
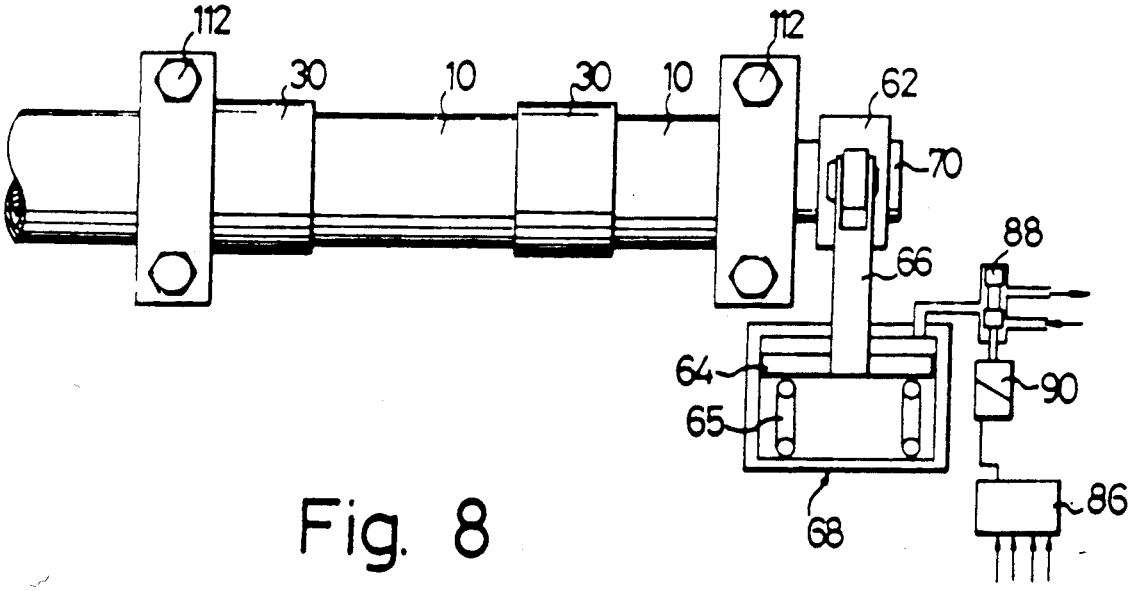
FIG. 8 is a schematic plane view showing another embodiment of the controlling of the rocker arm shaft by means of a hydraulic cylinder.
Figure 9:
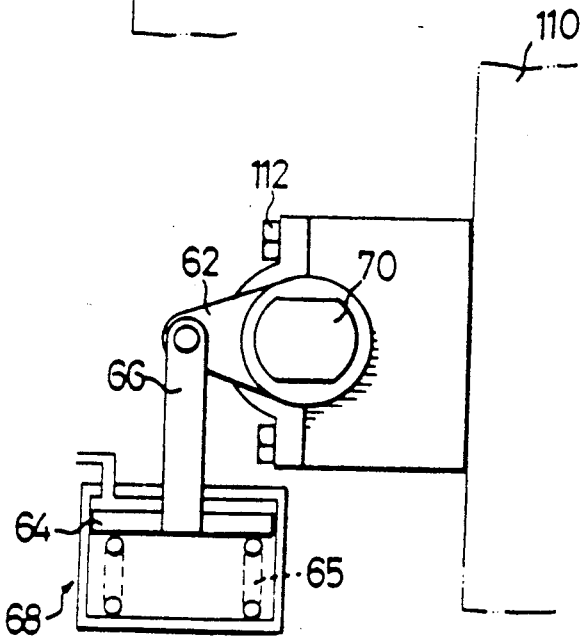
FIG. 9 is a right-side view of FIG. 8.

Please refer to FIGS. 8 and 9 in which another embodiment of the present invention is shown. This illustration of an embodiment utilizes an electromagnetic flow control valve 90 in cooperation with a hydraulic cylinder 68 and the ECU to control the position of the high speed rocker arm 40 in response to factors already mentioned in the above. An attachment means 62 is mounted on the fluted shaft 70 with its distal end attached to a piston rod of a piston 64 within a hydraulic cylinder 68. For illustration, if the engine is initially at a low speed, and is increased to a pre-set valve, the electromagnetic flow control valve 90 is actuated by the ECU upon received messages of above-mentioned factors, and the gate means 88 is opened to allow fluid flow into the hydraulic cylinder 68 and to compress the spring 65 therein. Then, the attachment means 62 together with the fluted shaft 70 rotate to another position such that the phase angle of high speed rocker arm 40 and the high speed cam 54 is increased. Accordingly, the valve-timing is changed and controlled by the high speed rocker arm 40 and the high speed cam 54. Conversely, the valve-timing is changed from a high engine speed to a low engine speed when the engine speed changes from high to low speed, the valve-timing is controlled again by the low speed rocker arm again. This type has only a two-step control, i.e., the high speed rocker arm does not contact with the high speed cam lobe at low engine speed when the low speed cam controls the opening and closing of the valve, and the high speed rocker arm contacts with the high speed cam lobe and completely replaces the low speed rocker arm to control the valve when the engine is over a pre-set speed or the controller has over-ridden engine speed considerations alone and has taken other factors into consideration, other factors are now controlling.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A variable valve-timing device for an intake or exhaust valve in a cylinder head of an internal combustion engine operated directly from a camshaft comprising:

a low speed rocker arm mounted on a low speed rocker arm shaft;

a high speed rocker arm mounted on a high speed rocker arm shaft;

said low speed rocker arm and said high speed rocker arm being interconnected by a pin provided in a pin hole of said low speed rocker arm and a pin slot of said high speed rocker arm adjacent to said valve, a first portion of said pin being tightly received in said pin hole of said low speed rocker arm and a second portion of said pin being received in said pin slot of said high speed rocker arm, said pin slot of said high speed rocker arm extending in a direction perpendicular to a longitudinal axis of said pin so as to allow said high speed rocker arm to move relative to said low speed rocker arm;

a low speed cam being provided on said camshaft corresponding with said low speed rocker arm, said low speed cam having a first cam lobe which has a first cam face for contacting with a first rocker arm face of said low speed rocker arm;

a high speed cam being provided on said camshaft corresponding with said high speed rocker arm, said high speed cam having a second cam lobe which has a second cam face for contacting with a second rocker arm face of said high speed rocker arm;

said low speed rocker arm shaft and said high speed rocker arm shaft having a common fluted shaft, an outer circular hollow shaft being provided on said common fluted shaft and said low speed rocker arm being mounted on said outer circular hollow shaft which is fixedly mounted on an engine head by means of suitable fixing means, an outer hollow eccentric shaft having a slot with a cross section corresponding to said common fluted shaft being provided on said common fluted shaft and said high speed rocker arm being mounted on said eccentric shaft which is rotatably mounted on said engine head, an end of said fluted shaft being provided with a transmission means connected to an output shaft of a driving means, said driving means being controlled by means of a power controlling unit in response to engine operating factors to rotate said high speed rocker arm to move relative to said low speed rocker arm through said transmission means, said eccentric shaft and said fluted shaft to cause a change of relative phase angle of said high speed cam and said high speed rocker arm while a relative phase angle of said low speed cam and said low speed rocker arm remains unchanged.

2. A variable valve-timing device as claim in claim 1 wherein said driving means is a step motor.

3. A variable valve-timing device as claimed in claim 1 wherein said driving means is an electromagnetic flow control valve with a hydraulic cylinder.

4. A variable valve-timing device as claimed in claim 1 wherein said engine operating factors include engine speed, engine load, car speed, and water temperature of cooling system, etc.

5. A variable valve-timing device as claimed in claim 2 wherein said transmission means includes a worm wheel on said fluted shaft and a worm gear meshed with said worm wheel and attached to said output shaft of said driving means.

6. A variable valve-timing device as claimed in claim 3 wherein said transmission means includes an attachment means mounted on said fluted means and connected to said output shaft of said driving means.

* * * * *